US007413553B2

(12) United States Patent
Chen

(10) Patent No.: US 7,413,553 B2
(45) Date of Patent: Aug. 19, 2008

(54) EXERCISING APPARATUS

(76) Inventor: Chin-Te Chen, No. 26, alley 26, Lane 57, Chenggong Rd., Dali City, Taichung Hsien (TW)

( * ) Notice: Subject to any disclaimer, the term of this patent is extended or adjusted under 35 U.S.C. 154(b) by 0 days.

(21) Appl. No.: 11/640,338

(22) Filed: Dec. 18, 2006

(65) Prior Publication Data

US 2008/0146976 A1 Jun. 19, 2008

(51) Int. Cl.

| | |
|---|---|
| ***A61H 1/00*** | (2006.01) |
| ***A61H 1/02*** | (2006.01) |
| ***A61H 5/00*** | (2006.01) |
| ***A61H 7/00*** | (2006.01) |
| ***A61H 19/00*** | (2006.01) |

(52) U.S. Cl. ..... 601/28; 601/31; 601/32; 601/35; 601/93; 601/104

(58) Field of Classification Search ..... 482/79, 482/80, 146, 147, 907; 601/26, 31, 84, 92, 601/22, 23, 27–30, 51, 53, 87, 35, 93, 104
See application file for complete search history.

(56) References Cited

U.S. PATENT DOCUMENTS

| | | | | |
|---|---|---|---|---|
| 6,572,514 | B1 * | 6/2003 | Calafato | 482/79 |
| 6,749,539 | B2 * | 6/2004 | Hsieh | 482/51 |

* cited by examiner

*Primary Examiner*—LoAn H. Thanh
*Assistant Examiner*—Zackary Schoemer
(74) *Attorney, Agent, or Firm*—Rabin & Berdo, P.C.

(57) ABSTRACT

An exercising apparatus includes a base, two supporting brackets, a driving assembly, a pedal assembly and a case. The supporting brackets are mounted on the base. The driving assembly includes a motor, an eccentric wheel and a lifting bracket. The motor has a motor shaft. The eccentric wheel is mounted eccentrically on the motor shaft. The lifting bracket has a wheel slot and two pivoting brackets. The wheel slot is defined through the lifting bracket and engages the eccentric wheel. The pivoting brackets are formed near two ends of the lifting bracket. The pedal assembly includes two pedals and two pedal pads. The pedals are mounted respectively and pivotally on the supporting brackets and the pivoting brackets of the lifting bracket. The pedal pads are mounted respectively on the pedals. The case is mounted on the base and has two openings corresponding to the pedal pads.

10 Claims, 9 Drawing Sheets

EXERCISING APPARATUS

BACKGROUND OF THE INVENTION

1. Field of Invention

The present invention relates to an exercising apparatus, and more particularly to an exercising apparatus that is provided for shaking a user's heels up and down to produce exercising effect.

2. Description of the Related Art

A conventional exercising apparatus comprises an eccentric axle and a pulsating disc. The pulsating disc is connected to and is driven by the eccentric axle to shake the pulsating disc horizontally. When a user stand on the pulsating disc, the user is shaken horizontally by the pulsating disc and an exercising effect is provided to the user to improve the user's blood circulation.

Though the conventional exercising apparatus can provide exercising effect to the user, the horizontal movement of the pulsating disc is too violent and the user can not stand on the pulsating disc for a long time and easily fall off from the pulsating disc. The horizontal movement of the pulsating disc also causes itching and unpleasant feelings or even makes the user vomit.

To overcome the shortcomings, the present invention provides an exercising apparatus to mitigate or obviate the aforementioned problems.

SUMMARY OF THE INVENTION

The primary objective of the present invention is to provide an exercising apparatus that can provide up and down to a user's heels to produce exercising effect.

An exercising apparatus in accordance to the present invention comprises a base, two supporting brackets, a driving assembly, a pedal assembly and a case. The base comprises a panel having a top surface, a bottom surface, a front side, a rear side and two ends. The supporting brackets are mounted respectively on the front side of the panel near the ends of the panel and each supporting bracket has a top end having a height and a bottom end connected to the top surface of the panel of the base.

The driving assembly comprises a motor base, two guide rods, a motor, an eccentric wheel and a lifting bracket. The motor base is mounted on the top surface of the panel behind the supporting brackets and comprises a lower plank, an upper plank and a flange. The lower plank is mounted on the top surface of the panel and has a rear edge. The upper plank is mounted on, protrudes perpendicularly from the rear edge of the lower plank and has a top edge, a bottom edge connected to the rear edge of the lower plank and a shaft hole defined through the upper plank of the motor base. The flange is connected to the top edge of the upper plank and has a length, two ends and two guide holes defined respectively through the flange near the left end and the right end of the flange. The guide rods are mounted respectively in and extend perpendicularly through the guide holes of the flange. The motor is mounted on the lower plank of the motor base and has a motor shaft extending transversely through and protruding from the shaft hole in the upper plank of the motor base and has an extending end. The eccentric wheel is mounted eccentrically on the extending end of the motor shaft. The lifting bracket is extending longitudinally between the upper plank and the flange of the motor base and has a length, a middle, a top edge, two ends, a wheel slot, two through holes and two pivoting brackets. The wheel slot is defined transversely through the middle of the lifting bracket and engaging the eccentric wheel. The through holes correspond and engage to the guide rods respectively and are defined perpendicularly through the bracket. The pivoting brackets are formed respectively on the top edge of the bracket near the ends of the bracket and corresponds respectively to the supporting brackets. Each pivoting bracket has a top end having a height higher than the height of the top end of the corresponding supporting bracket.

The pedal assembly comprises two pedals and two pedal pads. The pedals are mounted respectively and pivotally on the top ends of the supporting brackets and the pivoting brackets of the lifting bracket and each pedal comprises a pedal panel having a front side, a rear side, a top surface and a bottom surface. The pedal pads are mounted respectively on the top surfaces of the pedal panels.

The case is mounted on the top surface of the panel of the base and has a top surface, a front surface, two ends and two openings defined through the top surface of the case and corresponding to the pedal pads of the pedal assembly.

Other objectives, advantages and novel features of the invention will become more apparent from the following detailed description when taken in conjunction with the accompanying drawings.

DETAILED DESCRIPTION OF THE INVENTION

Figure 1:
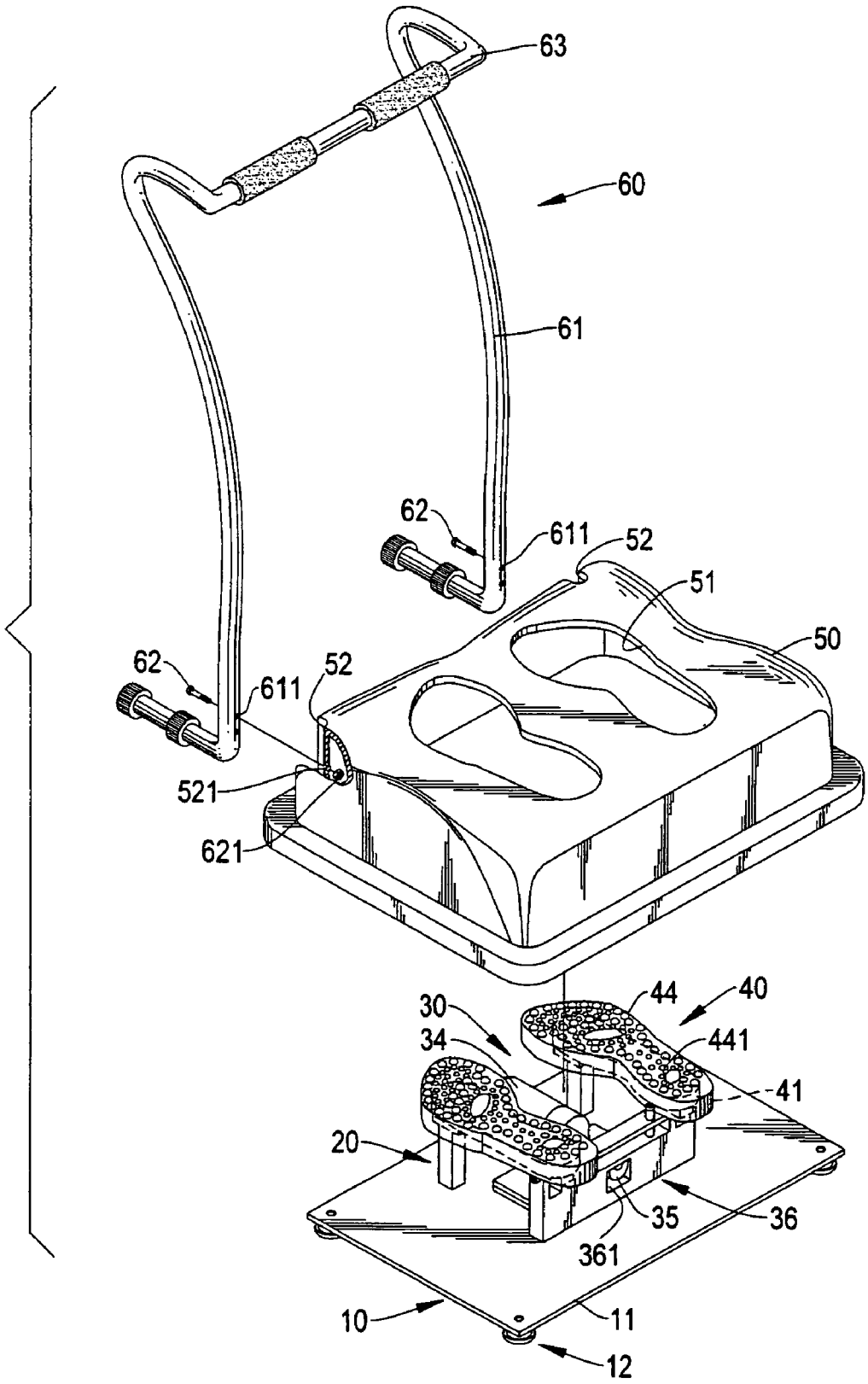
FIG. 1 is an exploded perspective view of an exercising apparatus in accordance with the present invention.
Figure 2:
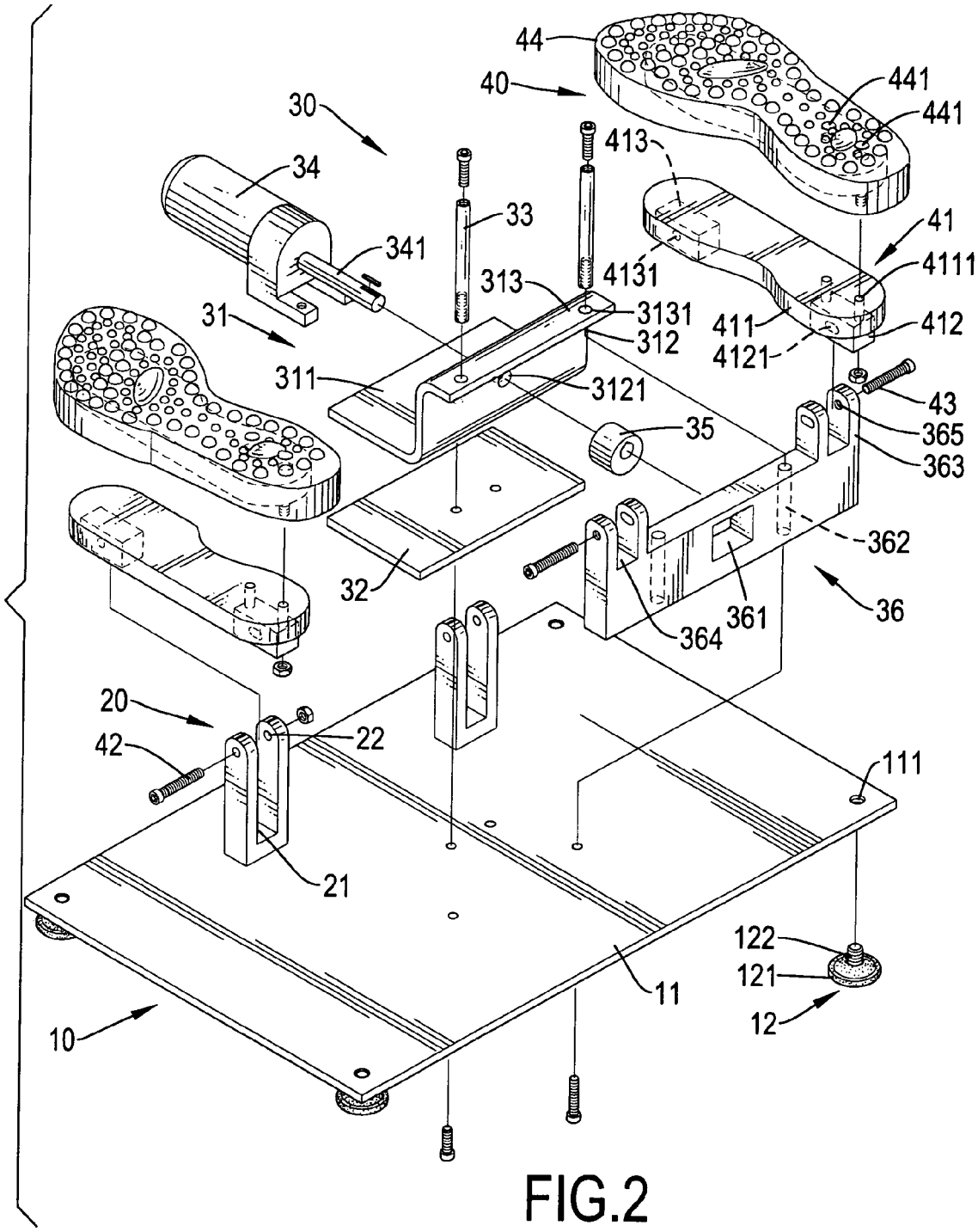
FIG. 2 is an exploded perspective view of the exercising apparatus in FIG. 1.
Figure 3:
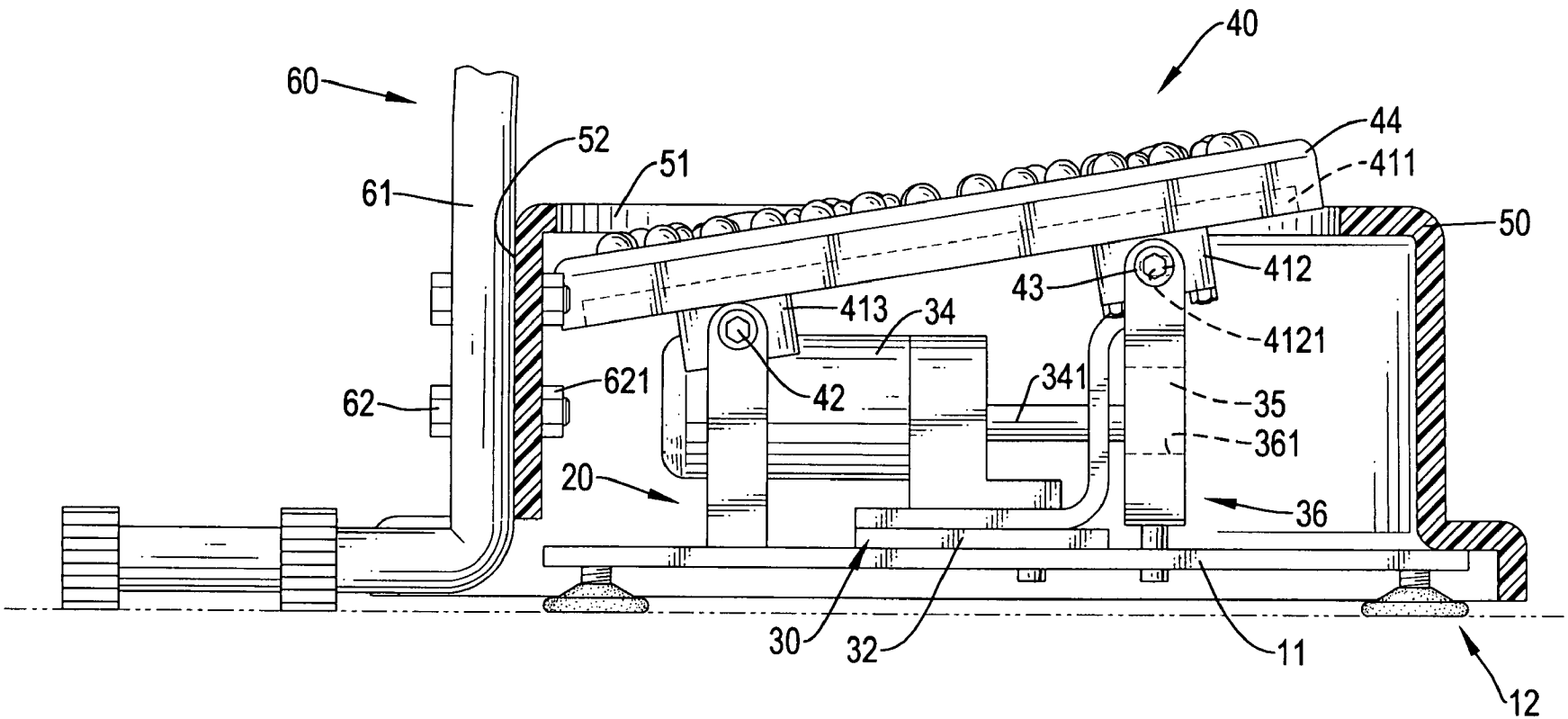
FIG. 3 is a side view in partial section of the exercising apparatus in FIG. 1.
Figure 4:
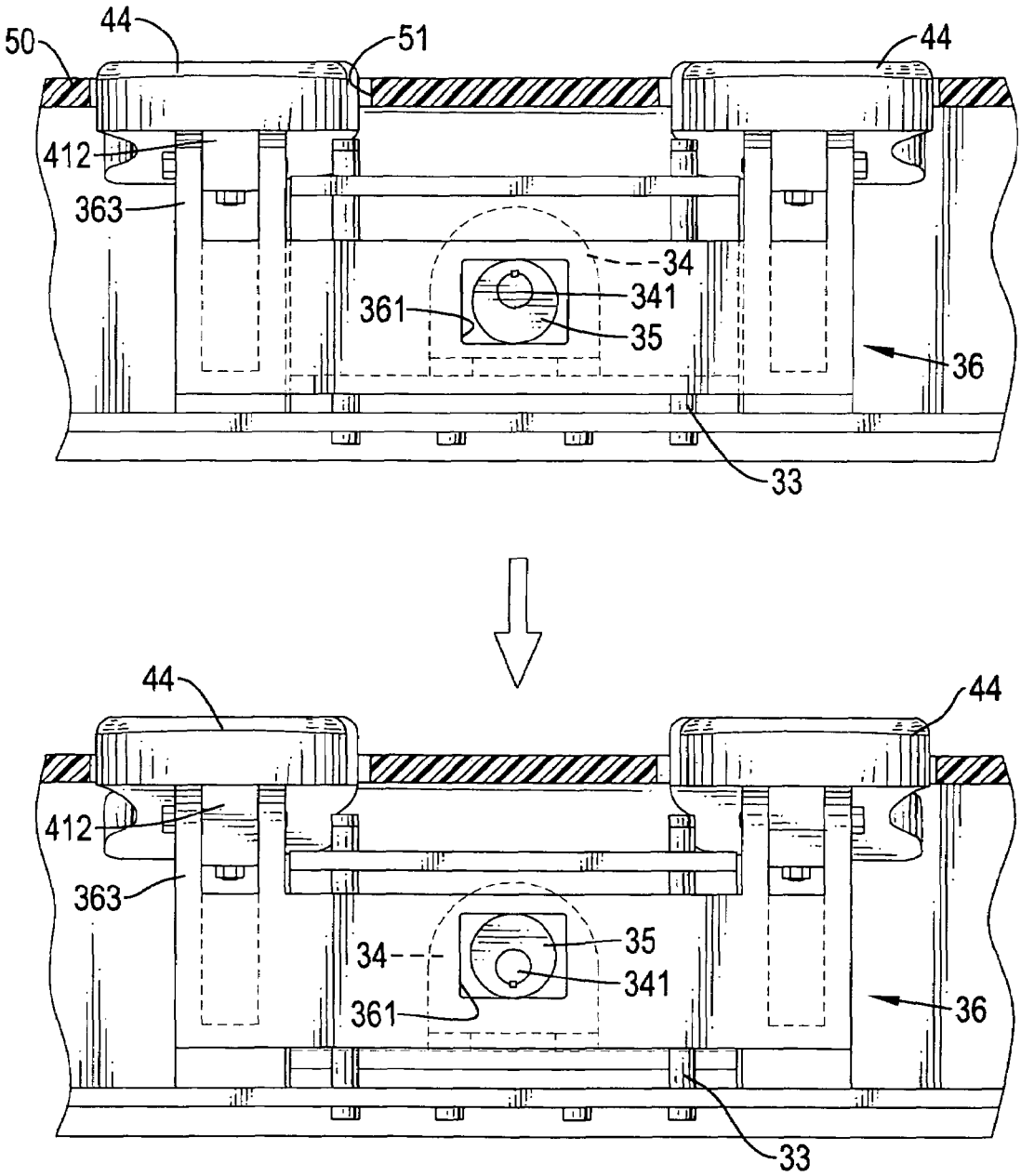
FIG. 4 is an operational rear view in partial section of the exercising apparatus in FIG. 1.
Figure 5:
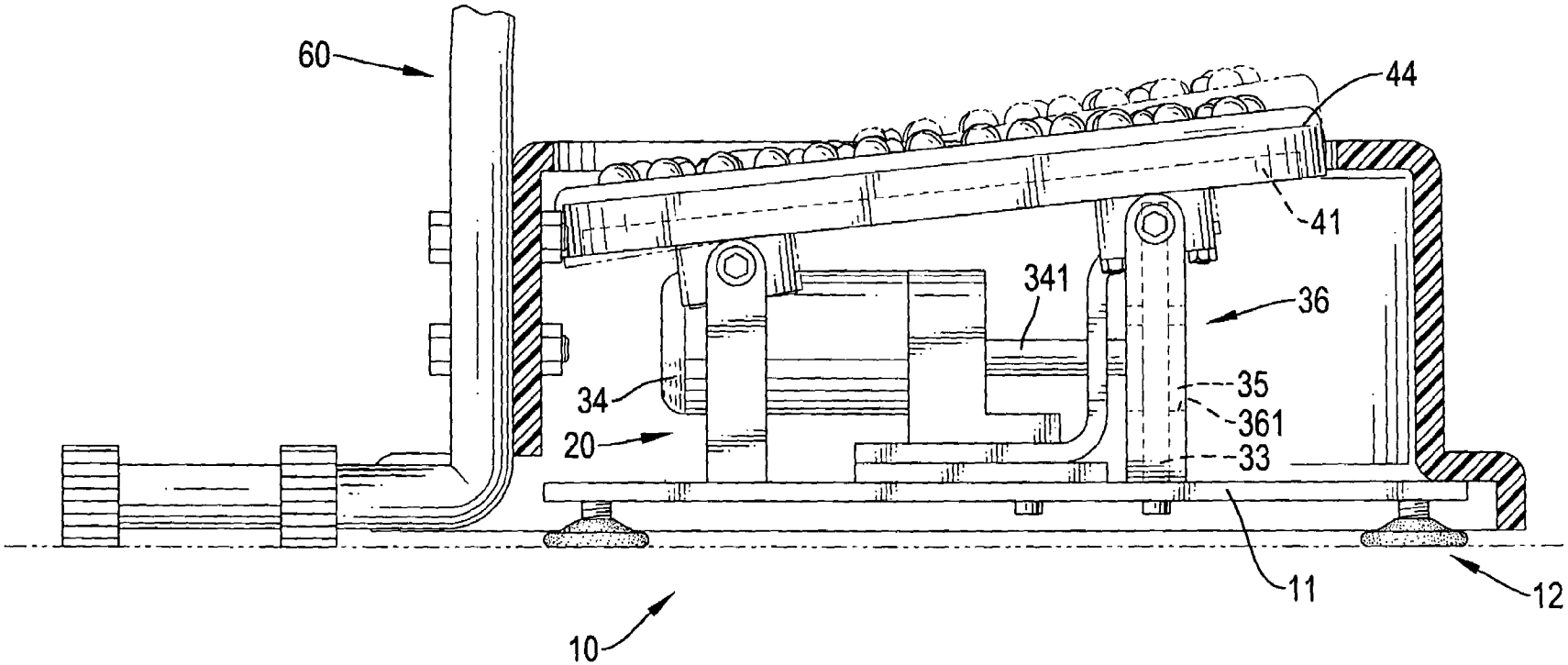
FIG. 5 is an operational side view of the exercising apparatus in FIG. 1.
Figure 6:
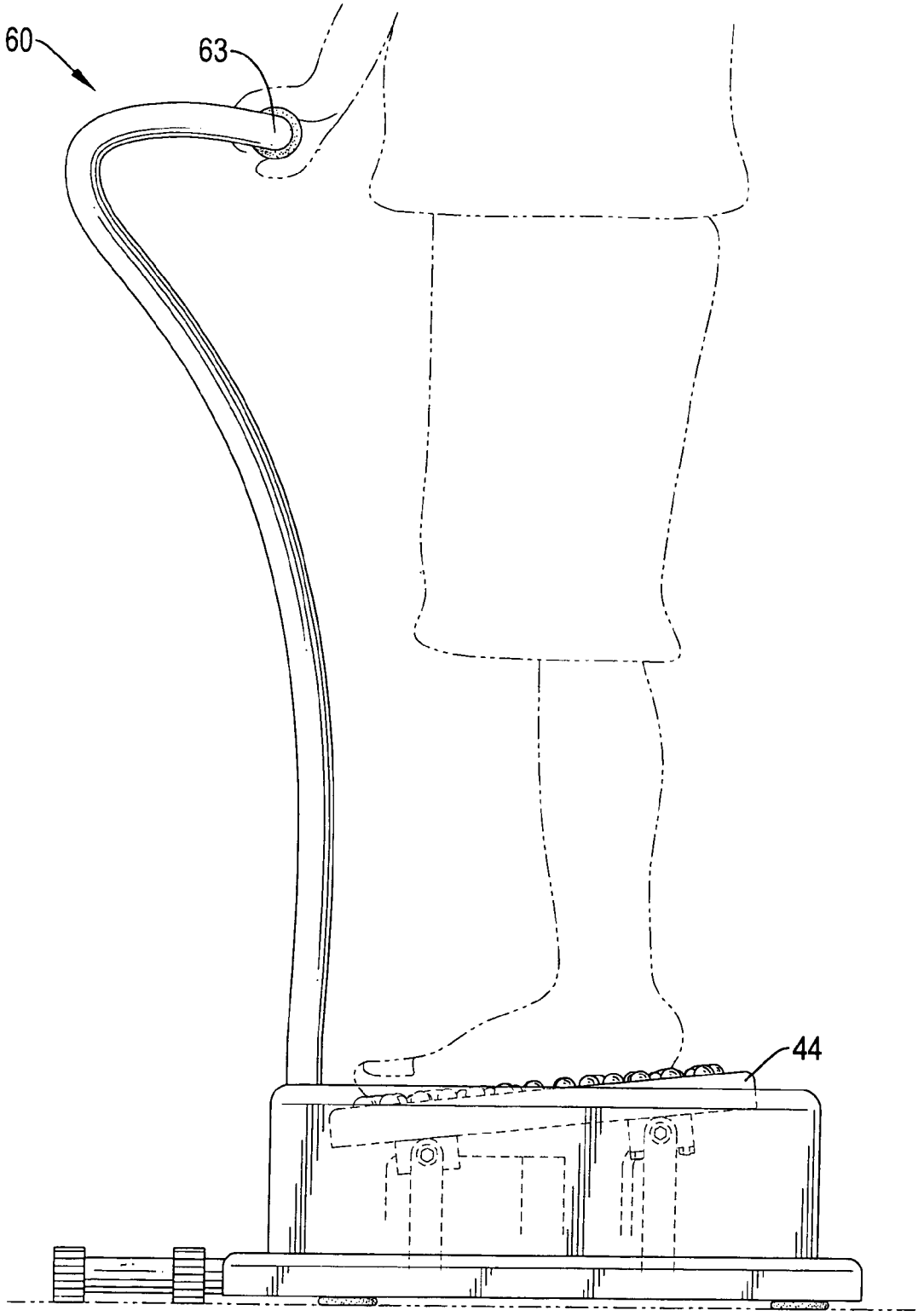
FIG. 6 is a side view of the exercising apparatus in FIG. 1 with a user putting his feet on the pedal pads.

With reference to FIGS. 1, 2, 3, 4 and 8, an exercising apparatus in accordance with the present invention comprises a base (10), two supporting brackets (20), a driving assembly (30), a pedal assembly (40), a case (50) and a handle (60) and may further have a foot pillow (70) and a controller (80).

The base (10) comprises a panel (11) and multiple legs (12). The panel (11) is rectangular and has a top surface, a bottom surface, a front side, a rear side, two ends and multiple threaded holes (111). The threaded holes (111) are defined through the panel (11). The legs (12) are mounted respectively in the threaded holes (111) of the panel (11) and each leg (12) has a supporting block (121) and a bolt (122). The supporting block (121) faces the bottom surface of the panel (11). The bolt (122) is mounted on the supporting block (121) and is screwed into a corresponding threaded hole (111).

The supporting brackets (20) are mounted respectively near the ends of the panel (11) on the front side of the panel (11) and extend perpendicularly from the panel (11). Each supporting bracket (20) is U-shaped and has a top end, a bottom end, a notch (21) and a through hole (22). The top end has a height relative to the panel (11). The bottom end is attached to the top surface of the panel (11). The notch (21) is defined perpendicularly in the top end of the supporting bracket (20). The through hole (22) is defined through the top end of the supporting bracket (20).

The driving assembly (30) is mounted on the base (10) and comprises a motor base (31), a shock-absorbing pad (32), two guide rods (33), a motor (34), an eccentric wheel (35) and a lifting bracket (36). The motor base (31) is mounted on the top surface of the panel (11) near the supporting brackets (20) and comprises a lower plank (311), an upper plank (312) and a flange (313). The lower plank (311) is rectangular, is mounted on the top surface of the panel (11) and has a rear edge. The upper plank (312) is mounted on and protrudes perpendicularly from the rear edge of the lower plank (311) and has a top edge, a bottom edge and a shaft hole (3121). The bottom edge of the upper plank (312) is connected to the rear edge of the lower plank (311). The shaft hole (3121) is defined through the upper plank (312) of the motor base (31). The flange (313) is connected to the top edge of the upper plank (312) and has a length, two ends and two guide holes (3131). The guide holes (3131) are defined respectively through the flange (313) near the ends of the flange (313).

The shock-absorbing pad (32) is plastic and is mounted between the top surface of the panel (11) and the lower plank (311) of the motor base (31). The guide rods (33) are cylindrical, are mounted respectively in and extend perpendicularly through the guide holes (3131) of the flange (313). The motor (34) is mounted on the lower plank (311) of the motor base (31) and has a motor shaft (341). The motor shaft (341) extends transversely through and protrudes from the shaft hole (3121) in the upper plank (312) of the motor base (31) and has an extending end and a key. The key is mounted on the extending end of the motor shaft (31). The eccentric wheel (35) is mounted eccentrically on the extending end of the motor shaft (341) and has inner surface, a keyway and an outer diameter. The keyway is defined in the inner surface of the eccentric wheel (35) and engages the key on the extending end of the motor shaft (341).

The lifting bracket (36) is rectangular, extends longitudinally between the upper plank (312) and the flange (313) of the motor base (31) and has a middle, a top edge, two ends, a length, a wheel slot (361), two through holes (362) and two pivoting brackets (363). The length of the lifting bracket (36) is larger than that of the flange (313) so the ends of the lifting bracket (36) extend respectively out from the ends of the flange (313). The wheel slot (361) is rectangular, is defined transversely through the lifting bracket (36) in the middle of the lifting bracket (36), engages the eccentric wheel (35) and has a width same as the outer diameter of the eccentric wheel (35). The through holes (362) are defined perpendicularly through the lifting bracket (36), correspond respectively to and hold the guide rods (33) so the lifting bracket (36) can slide along the guide rods (33) up and down. The pivoting brackets (363) are formed on the top edge of the lifting bracket (36) respectively near the ends of the lifting bracket (36) and corresponds respectively to the supporting brackets (33). Each pivoting bracket (363) is U-shaped and has a top end, a notch (364) and a threaded hole (365). The top end of the pivoting bracket (363) has a height relative to the panel (11) and higher than that of the top end of a corresponding supporting bracket (20). The notch (364) is defined perpendicularly in the top end of the pivoting bracket (363) and aligns with the notch (21) in a corresponding supporting bracket (20). The threaded hole (365) is defined longitudinally through the top end of the pivoting bracket (363).

The pedal assembly (40) comprises two pedals (41) and two pedal pads (44). The pedals (41) are mounted respectively and pivotally on the supporting brackets (20) and the pivoting brackets (363) of the lifting bracket (36), and each pedal (41) comprises a pedal panel (411), a front connector (413), a rear connector (412), a front bolt (42) and a rear bolt (43). The pedal panel (411) has a front side, a rear side, a top surface, a bottom surface and two mounting holes (4111) defined in the top surface of the pedal panel (411) near the rear side of the pedal panel (411) and aligned transversely with each other. The front connector (413) is mounted on the bottom surface of the pedal panel (411) near the front side of the pedal panel (411), is mounted pivotally in the notch (21) in a corresponding supporting bracket (20) and has a pivotal hole (4131). The pivotal hole (4131) is defined longitudinally through the front connector (413) and is aligned with the through hole (22) of the corresponding supporting bracket (20). The rear connector (412) mounted on the bottom surface of the pedal panel near the rear side of the pedal panel (11) is mounted pivotally in the notch (364) in a corresponding pivoting bracket (363) of the lifting bracket (36) and has a pivotal hole (4121). The pivotal hole (4121) is defined longitudinally through the rear connector (412) and is aligned with the threaded hole (365) in the corresponding pivoting bracket (363) of the lifting bracket (36). The front bolt (42) extends through the pivotal hole (4131) of the front connector (413) and the through hole (22) of the corresponding supporting bracket (20) to pivotally connect the front connector (413) to the corresponding supporting bracket (20). The rear bolt (43) extends through the pivotal hole of the rear connector (412) and is screwed into the threaded hole (365) in the corresponding pivoting bracket (363) of the lifting bracket (36) to pivotally connect the rear connector (412) to the corresponding pivoting bracket (363). The pedal pads (44) are made of resilient material, are mounted respectively on the top surfaces of the pedal panels (411) and each pedal pad (44) has two mounting holes (441) aligned respectively with the mounting holes (4111) in the top surface of a corresponding pedal panel (411).

The case (50) is hollow, is mounted on the top surface of the panel (11) to cover the supporting brackets (20), the driving assembly (30) and the pedal assembly (40) and has a top surface, a front surface, two ends, two openings (51) and two grooves (52). The openings (51) are defined through the top surface of the case (50) and correspond to the pedal pads (44) of the pedal assembly (40). The grooves (52) are defined respectively and perpendicularly in the front surface of the case (50) near the ends of the case (50) and each groove (52) has a bottom and two securing holes (521). The securing holes (521) are defined through the bottom of the groove (52) and are aligned perpendicularly with each other.

The handle (60) is mounted on the case (50) and has two supporting rods (61) and a connecting rod (63). The supporting rods (61) are L-shaped, are mounted respectively in the grooves (52) in the front surface of the case (50) and each supporting rod (61) has a top, a bottom, two fastening holes (611), two bolts (62) and two nuts (621). The fastening holes (611) are defined through the supporting rod (61) near the bottom of the supporting rod (61) and correspond respectively and are aligned with the securing holes (521) in one of the grooves (52) in the front surface of the case (50). The bolts (62) are mounted respectively in and extend through the fastening holes (621) in the supporting rod (61) and the securing holes (521) in the corresponding groove (52) in the front surface of the case (50). The nuts (621) are screwed respectively on the bolts (62) of the supporting rod (61) to secure (60) the handle onto the case (50). The connecting rod (63) is mounted on the tops of the supporting rods (61).

With reference to FIGS. 3, 4, 5 and 6, when the exercising apparatus is in use, a user puts his feet respectively on the pedal pads (44) of the pedal assembly (40) and grips the handle (60). Because the top ends of the pivoting brackets (363) of the lifting bracket (36) is higher than the top ends of the supporting brackets (20), the rear sides of the pedal panels (411) are higher than the front sides of the pedal panels (411). Accordingly, the pedal pads (44) and the user's soles are inclined downward toward the front side of the panel (11).

Figure 7:
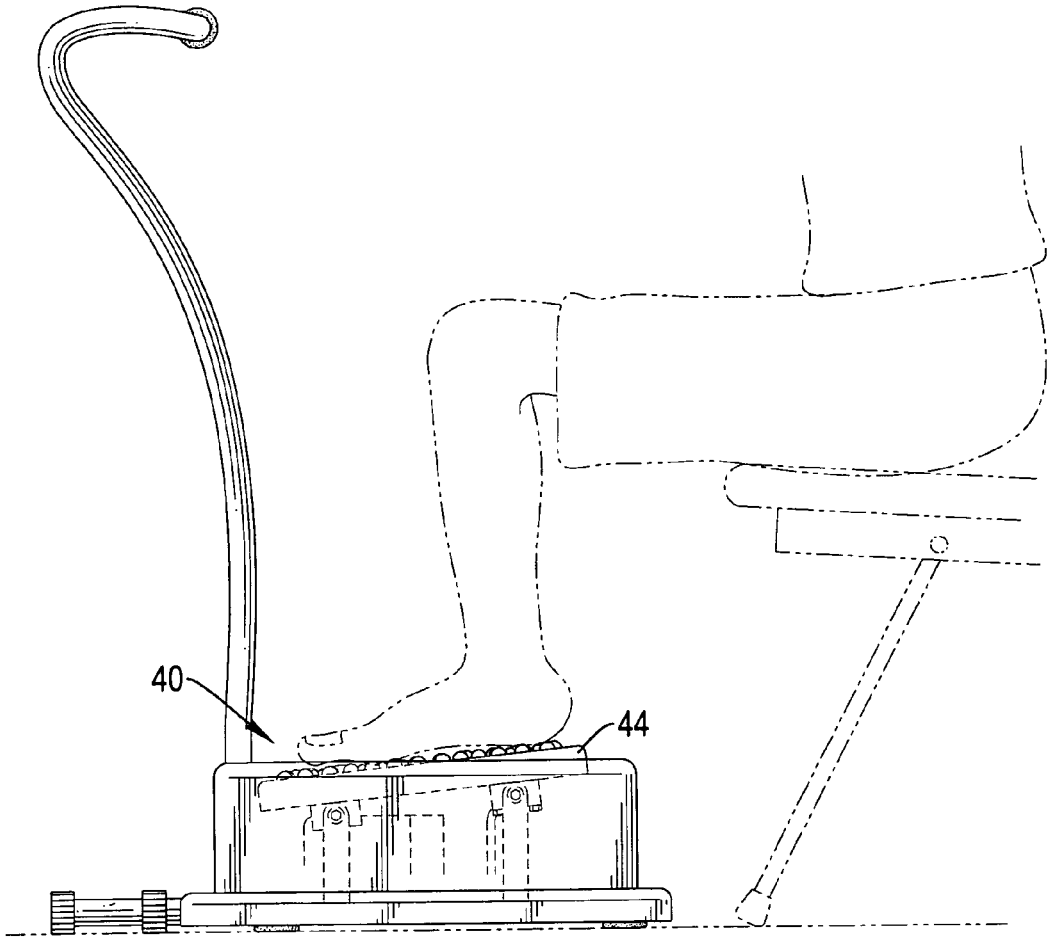
FIG. 7 is a side view of the exercising apparatus in FIG. 1 with a user sitting on a chair and putting his feet on the pedal pads.

When the motor (34) of the driving assembly (30) is turned on, the eccentric wheel (35) is rotated by the motor (34) and the lifting bracket (36) moves up and down along the guide rods (33). The pivoting brackets (363) of the lifting bracket (36) are connected to the rear connectors (412) on the pedal panels (411) and drive the rearsides of the pedal panels (411) to move up and down. Accordingly, continuous and gentle up and down movement is provided to the user's heels and the user is exercised comfortably. The up and down movement applied to the user also improves the user's blood circulation, increases peristaltic movement of the user's digestive tract and is helpful to the user's health. With reference to FIG. 7, the user can also sit on a chair and put his feet on the pedal pads (44) to have an exercising effect.

Figure 8:
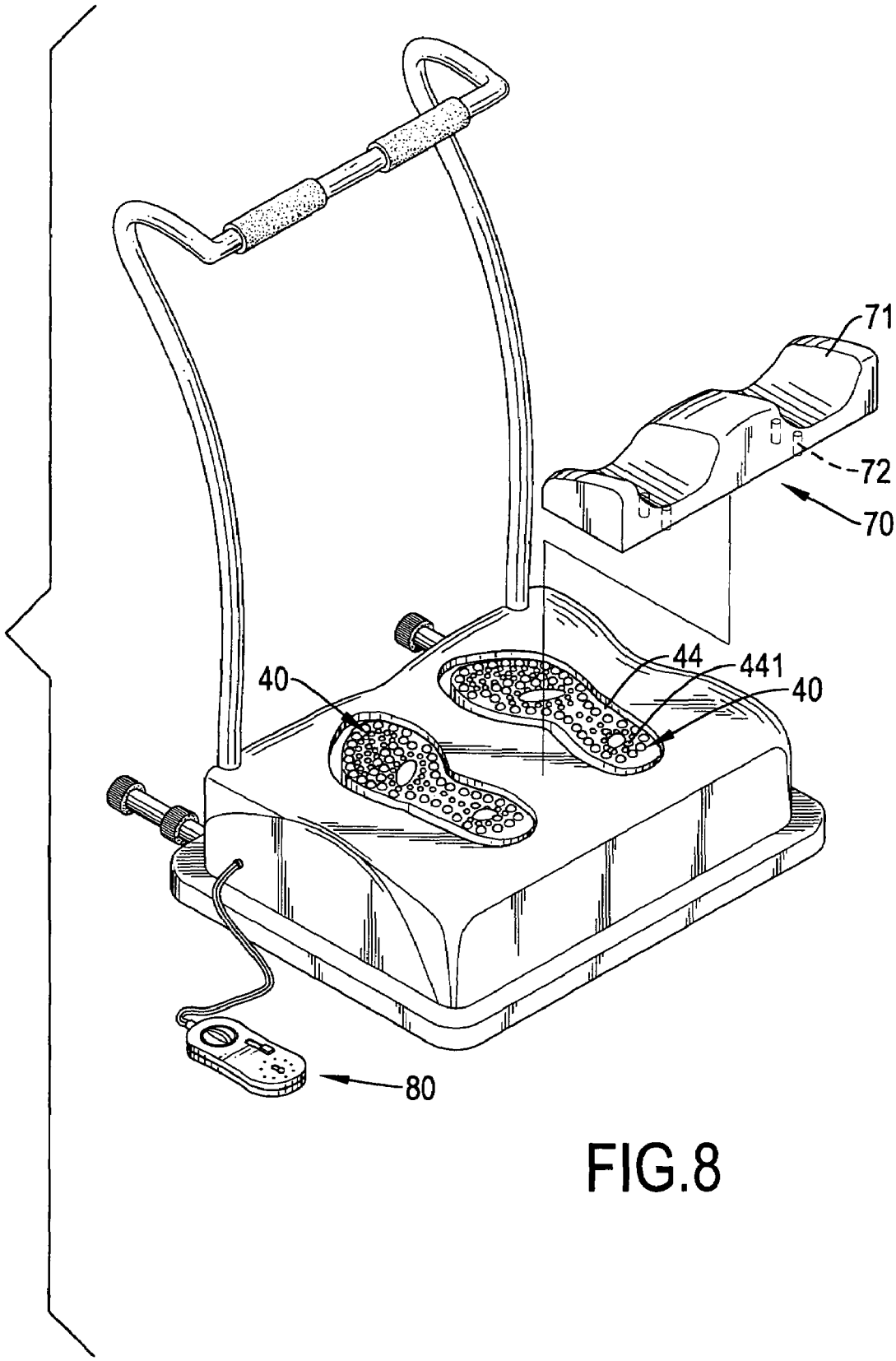
FIG. 8 is an exploded perspective view of the exercising apparatus in FIG. 1 with a foot pillow and a controller.
Figure 9:
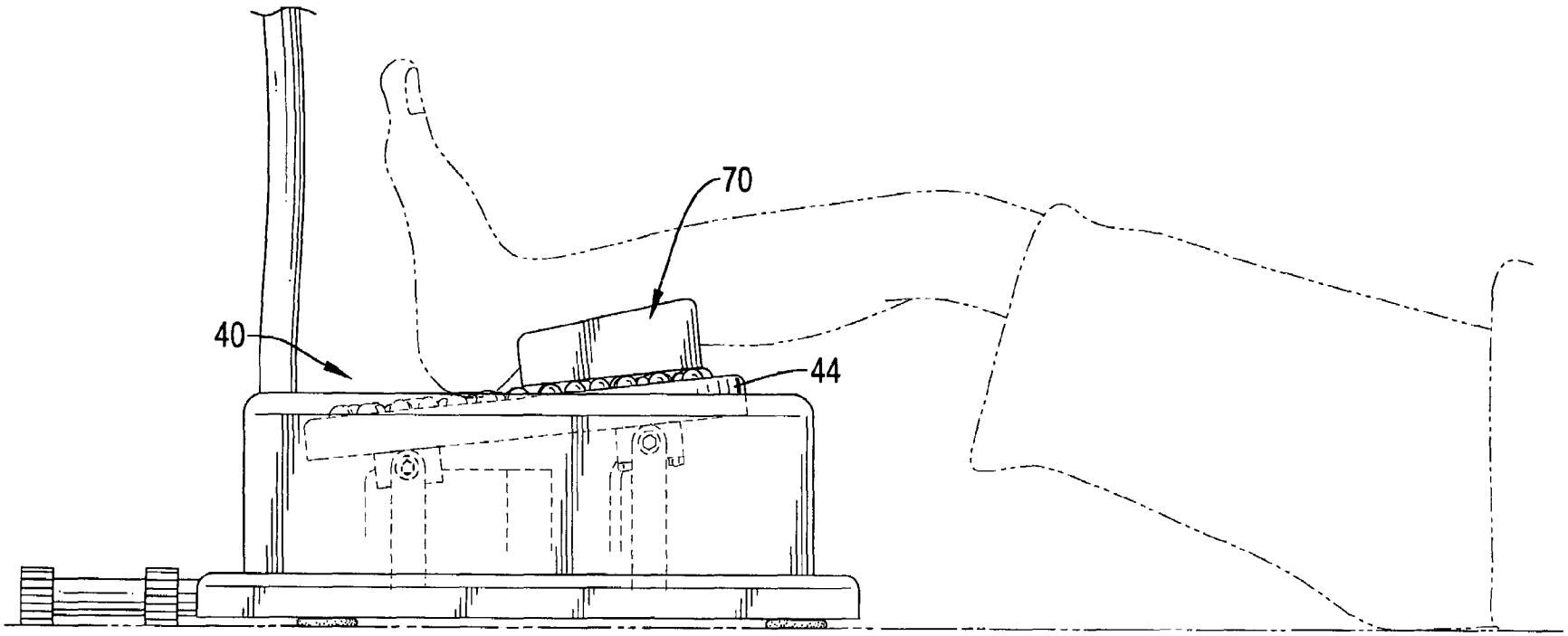
FIG. 9 is a side view of the exercising apparatus in FIG. 1 with a user lying down and putting his ankles on the foot pillow.

With further reference to FIGS. 8 and 9, the foot pillow (70) is rectangular and has a top surface, a bottom surface, two ends, two recesses (71) and two pairs of sticks (72). The recesses (71) are defined transversely in the top surface of the foot pillow (70) respectively near the ends of the foot pillow (70). The pairs of the sticks (72) are mounted respectively on the bottom surface of the foot pillow (70) near the ends of the foot pillow (71). Each pair of sticks (72) is mounted respectively in the mounting holes (441) in one of the pedal pads (44) and the mounting holes (4111) in a corresponding pedal panel (411) to fasten the foot pillow (70) on the pedal pad (44). The user can put his ankles respectively in the recesses (71) of the foot pillow (70) when the user is lying down. Thereby, the user can exercise his feet alternatively by means of the up and down movement provided by the foot pillow (70) and improve his blood circulation.

The controller (80) is electrically connected to the motor (34) of the driving assembly (40) to control speed of the lifting bracket (36) and lifting frequency of the pedal pads (44) of the pedal assembly (40).

Even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. An exercising apparatus comprising:

a base comprising a panel having
- a top surface;
- a bottom surface;
- a front side;
- a rear side; and
- two ends;

two supporting brackets being mounted respectively on the front side of the panel near the ends of the panel and each supporting bracket having
- a top end having a height relative to the panel; and
- a bottom end being mounted on the top surface of the panel of the base;

a driving assembly mounted on the base and comprising a motor base being mounted on the top surface of the panel near the supporting brackets and comprising
- a lower plank being mounted on the top surface of the panel and having a rear edge;
- an upper plank being mounted on and protruding perpendicularly in from the rear edge of the lower plank and having
  - a top edge;
  - a bottom edge being connected to the rear edge of the lower plank; and
  - a shaft hole being defined through the upper plank of the motor base; and
- a flange being connected to the top edge of the upper plank and having
  - a length;
  - two ends; and
  - two guide holes being defined respectively through the flange near the ends of the flange;

two guide rods being mounted respectively in and extending perpendicularly through the guide holes of the flange;

a motor being mounted on the lower plank of the motor base and having a motor shaft extending transversely through and protruding from the shaft hole in the upper plank of the motor base and having an extending end;

an eccentric wheel being mounted eccentrically on the extending end of the motor shaft; and a lifting bracket being extending longitudinally between the upper plank and the flange of the motor base and having
- a length;
- a middle;
- a top edge;
- two ends;
- a wheel slot being defined transversely through the lifting bracket in the middle of the lifting bracket and engaging the eccentric wheel;
- two through holes being defined perpendicularly through the bracket and corresponding respectively to and engaging the guide rods; and
- two pivoting brackets being formed respectively on the top edge of the bracket near the ends of the lifting bracket and corresponding respectively to the supporting brackets, and each pivoting bracket having a top end having a height relative to the panel and higher than that of the top end of a corresponding supporting bracket;

a pedal assembly comprising two pedals being mounted respectively and pivotally on the top ends of the supporting brackets and the pivoting brackets of the lifting bracket and each pedal comprising a pedal panel having
- a front side;
- a rear side;
- a top surface; and
- a bottom surface; and two pedal pads being mounted respectively on the top surfaces of the pedal panels; and a case being mounted on the top surface of the panel and having
- a top surface;
- a front surface;

two ends; and two openings being defined through the top surface of the case and corresponding to the pedal pads of the pedal assembly.

2. The exercising apparatus as claimed in claim 1, wherein the length of the lifting bracket is larger than that of the flange and the ends of the lifting bracket extend respectively out from the ends of the flange;

each supporting bracket further has a notch being defined perpendicularly in the top end of the supporting bracket; and;

a through hole being defined through top end of the supporting bracket;

each pivoting bracket of the lifting bracket further has a notch being defined perpendicularly in the top end of the pivoting bracket and aligned with the notch of a corresponding supporting bracket; and a threaded hole being defined through the top end of the pivoting bracket; and each pedal further comprises a front connector being mounted on the bottom surface of the pedal panel near the front side of the pedal panel, being mounted pivotally in the notch of a corresponding supporting bracket and having a pivotal hole defined through the front connector and aligned with the through hole of the corresponding supporting bracket;

a rear connector being mounted on the bottom surface of the pedal panel near the rear side of the pedal panel, being mounted pivotally in the notch of a corresponding pivoting bracket of the lifting bracket and having a pivotal hole defined through the rear connector and aligned with the threaded hole of the corresponding pivoting bracket of the lifting bracket;

a front bolt extending through the pivotal hole of the front connector and the through hole of the corresponding supporting bracket; and a rear bolt extending through the pivotal hole of the rear connector and screwed into the threaded hole of the corresponding pivoting bracket of the lifting bracket.

3. The exercising apparatus as claimed in claim 1, wherein the case further has two grooves being defined perpendicularly in the front surface of the case respectively near the ends of the case;

each groove has a bottom and two securing holes defined through the bottom of the groove and aligned with each other; and the exercising apparatus further comprises a handle being mounted on the case and having two supporting rods being mounted respectively in the grooves in the front surface of the case and each supporting rod having a top;

a bottom;

two fastening holes being defined through the supporting rod near the bottom of the supporting rod and corresponding respectively to and aligned with the securing holes in a corresponding one of the grooves in the front surface of the case;

two bolts being mounted respectively in and extending through the fastening holes in the supporting rod and the securing holes in the corresponding groove in the front surface of the case; and two nuts being screwed respectively on the bolts of the supporting rod; and a connecting rod being mounted on the tops of the supporting rods.

4. The exercising apparatus as claimed in claim 1, wherein each pedal panel further has two mounting holes defined in the top surface of the pedal panel near the rear side of the pedal panel;

each pedal pad has two mounting holes aligned respectively with the mounting holes in the top surface of a corresponding pedal panel; and the exercising apparatus further has a foot pillow having a top surface;

a bottom surface;

two ends;

two recesses being defined respectively in the top surface of the foot pillow near the ends of the foot pillow; and two pairs of sticks being mounted respectively on the bottom surface of the foot pillow near the ends of the foot pillow and each pair of the sticks being mounted respectively in the mounting holes in one of the pedal pad and the mounting holes in a corresponding pedal panel.

5. The exercising apparatus as claimed in claim 2, wherein the case further has two grooves being defined perpendicularly in the front surface of the case respectively near the ends of the case;

each groove has two securing holes defined through the bottom of the groove and aligned with each other; and the exercising apparatus further comprises a handle being mounted on the case and having two supporting rods being mounted respectively in the grooves in the front surface of the case and each supporting rod having a top;

a bottom;

two fastening holes being defined through the supporting rod near the bottom of the supporting rod and corresponding respectively and aligned with the securing holes in a corresponding one of the grooves in the front surface of the case;

two bolts being mounted respectively in and extending through the fastening holes in the supporting rod and the securing holes in the corresponding groove in the front surface of the case; and two nuts being screwed respectively on the bolts of the supporting rod; and a connecting rod being mounted on the tops of the supporting rods.

6. The exercising apparatus as claimed in claim 2, wherein each pedal panel further has two mounting holes defined in the top surface of the pedal panel near the rear side of the pedal panel;

each pedal pad has two mounting holes aligned respectively with the mounting holes in the top surface of a corresponding pedal panel; and the exercising apparatus further has a foot pillow having a top surface;

a bottom surface; two ends;

two recesses being defined respectively in the top surface of the foot pillow near the ends of the foot pillow; and two pairs of sticks being mounted respectively on the bottom surface of the foot pillow near the ends of the foot pillow and each pair of the sticks being mounted respectively in the mounting holes in one of the pedal pad and the mounting holes in a corresponding pedal panel.

7. The exercising apparatus as claimed in claim 3, wherein each pedal panel further has two mounting holes defined in the top surface of the pedal panel near the rear side of the pedal panel;

each pedal pad has two mounting holes aligned respectively with the mounting holes in the top surface of a corresponding pedal panel; and the exercising apparatus further has a foot pillow having a top surface;

a bottom surface; two ends;

two recesses being defined respectively in the top surface of the foot pillow near the ends of the foot pillow; and two pairs of sticks being mounted respectively on the bottom surface of the foot pillow near the ends of the foot pillow and each pair of the sticks being mounted respectively in the mounting holes in one of the pedal pad and the mounting holes in a corresponding pedal panel.

8. The exercising apparatus as claimed in claim 4, wherein the panel of the base further has multiple threaded holes defined through the panel; and the base further comprises multiple legs mounted respectively in the threaded holes in the panel and each leg having a supporting block being facing the bottom surface of the panel; and a bolt being mounted on the supporting block and screwed into a corresponding threaded hole.

9. The exercising apparatus as claimed in claim 6, wherein the panel of the base further has multiple threaded holes defined through the panel; and the base further comprises multiple legs mounted respectively in the threaded holes in the panel and each leg having a supporting block being facing the bottom surface of the panel; and a bolt being mounted on the supporting block and screwed into a corresponding threaded hole.

10. The exercising apparatus as claimed in claim 7, wherein the panel of the base further has multiple threaded holes defined through the panel; and the base further comprises multiple legs mounted respectively in the threaded holes in the panel and each leg having a supporting block being facing the bottom surface of the panel; and a bolt being mounted on the supporting block and screwed into a corresponding threaded hole.

* * * * *